US006563404B2

(12) United States Patent
Fiedziuszko et al.

(10) Patent No.: US 6,563,404 B2
(45) Date of Patent: May 13, 2003

(54) VOLTAGE TUNABLE PATCH FILTER ELEMENT WITH DIELECTRICALLY LOADED SLOT

(75) Inventors: Slawomir J. Fiedziuszko, Palo Alto, CA (US); Raymond Kwok, San Jose, CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 09/880,381

(22) Filed: Jun. 13, 2001

(65) Prior Publication Data

US 2002/0190820 A1 Dec. 19, 2002

(51) Int. Cl.[7] ..... H01P 1/203
(52) U.S. Cl. ..... 333/205; 333/204
(58) Field of Search ..... 333/205, 204, 333/221, 223, 99 S, 158; 343/700 MS, 768, 770, 787, 797

(56) References Cited

U.S. PATENT DOCUMENTS 5,721,194 A * 2/1998 Yandrofski et al. ..... 505/210
5,721,195 A * 2/1998 Grothe et al. ..... 505/210
5,786,303 A * 7/1998 Mansour ..... 505/210
6,097,263 A * 8/2000 Mueller et al. ..... 333/17.1

* cited by examiner

*Primary Examiner*—Robert Pascal
*Assistant Examiner*—Dean Takaoka
(74) *Attorney, Agent, or Firm*—Perman & Green, LLP

(57) ABSTRACT

A patch filter element has an electrically-insulating substrate with an electrically conductive region on a first surface of said substrate, and a slot such as a crossed slot dividing the conductive region into a plurality of triangular sections. A mode coupling device, such as a cutout corner of a triangular section, induces orthogonal modes of vibration of an electromagnetic field about the plurality of sections. The ferroelectric oxide is disposed in the slot for adjusting a dielectric constant of the oxide in accordance with a bias voltage applied across the slot between adjacent ones of the sections for turning the patch filter element. Metallic walls may be constructed along edges of the slot for increased capacitance.

11 Claims, 2 Drawing Sheets

VOLTAGE TUNABLE PATCH FILTER ELEMENT WITH DIELECTRICALLY LOADED SLOT

BACKGROUND OF THE INVENTION

This invention relates to patch filter elements suitable for use in stripline and microstrip construction of microwave multiplexers and filters in electromagnetic communications systems and, more particularly, to the construction of a patch filter element incorporating dielectric and/or ferroelectric material for improved tuning capacity of the filter element.

Electromagnetic communications systems, such as those incorporating a communications satellite encircling the earth, employ electronic components such as filters and multiplexers for establishing communication channels. It is desired that such electronic components be of relatively small physical size and weight so as to facilitate their use in a satellite and, accordingly, patch filter elements constructed as microstrip and stripline components are used to advantage in the communications systems. It is also desirable to have a relatively large tuning range for such electronic components so that one construction of the electronic components can be employed in a variety of communications channels by simply altering a tuning thereof. However, presently available electronic components constructed of patch filter elements have a disadvantage in that they are not as readily tunable as would be desired, and may be limited over the range of operating frequency and/or bandwidth that may be desired, particularly in the situation where electronic tuning capability is desired.

SUMMARY OF THE INVENTION

The aforementioned disadvantage is overcome and other advantages are provided by a construction of a patch filter element wherein the patch is provided with one or more slots which are filled with a ferroelectric oxide. The patch with the one or more slots constitutes a slotted patch resonator. The slotted patch is constructed with a square or rectangular configuration, allowing operation as a dual mode resonator. The ferroelectric oxide has a dielectric constant significantly higher than the dielectric constant of air and, therefore, results in an increase in capacitive coupling between adjacent sections of the patch separated by the slot. The amount of the ferroelectric oxide placed in a slot is selected to provide a desired amount of capacitive coupling across the slot. For example, the extent of the filling of a slot along its longitudinal dimension can be selected to provide a desired amount of capacitance and coupling. Alternatively, in an embodiment of the invention wherein the foil is provided with depth at the sides of a slot, the amount of the depth of the filling of the slot with the ferroelectric oxide can be selected to provide a desired amount of capacity and coupling. The amount of capacitance between adjacent sections of the patch resonator establishes the resonant frequency of a mode of electromagnetic vibration, and thus, the electrical length of an edge of the patch.

The width of a slot is substantially less than one-half of the free-space wavelength of an electromagnetic signal applied to the patch filter element. Therefore, the presence of the narrow slot does not interfere with the capacity of the patch to resonate at a microwave frequency, but the presence of an elevated dielectric constant of material within the slot alters the resonant wavelength for signals applied to the patch filter element. In a preferred embodiment of the invention, the configuration of a crossed slot is employed centered within a square or rectangular shaped patch, the slots serving to divide the patch into four triangular regions. The slots serve for tuning the filter element and for coupling electromagnetic energy between adjacent ones of the triangular regions. In order to operate the patch filter element with resonance in two orthogonal modes, a discontinuity or asymmetry in the construction of the patch is provided for coupling between orthogonal modes of vibration of electromagnetic waves, a convenient form of such coupling device being the creation of a shoulder by cutting off a corner of the patch.

By virtue of the crossed slot, the four triangular regions are electrically insulated from each other. In a preferred form of construction of the patch filter element, the four triangular regions are constructed of electrically-conductive metallic foil or coating supported on a substrate such as a layer of dielectric insulating material which, in turn, is located on a ground plane. The ground plane may be a layer of electrically-conductive metallic foil. In accordance with a feature of the invention, it is noted that the application of electric fields between adjacent ones of the triangular regions alters the electrical characteristics of the ferroelectric oxide resulting in a shift of the resonant wavelength along an edge of the patch filter element. Thus, the resonant wavelength can be established by choice of length of the side of the patch as well as by a choice of a bias voltage impressed between adjacent triangular regions of the patch. The bias voltage provides for a fringing field across a narrow gap of the slot, this configuration of electric fields providing for accurate control of the dielectric properties of the ferroelectric material in the slot. This form of construction maintains a high Q (quality factor) by a quasi-TEM (transverse electromagnetic) mode of the patch resonator.

Thereby, in the utilization of the slotted patch for construction of a filter, such as a passband filter, one can choose resonant frequencies for sections of the filter electrically by choice of the impressed voltages. Additional sections of the filter can be constructed by employing additional slotted patches, and tuning of the filter can be accomplished electrically. The amount of coupling between adjacent triangular regions of a patch is selected by choice of width of a slot as well as the amount of ferroelectric material present in the slot, wherein a greater slot width reduces the coupling and a smaller slot width increases the coupling. Since the coupling is one of the parameters in development of the overall spectral characteristics of the filter, the availability of choice in coupling in combination with the electronic tuning allows for establishment of a desired spectral characteristic of the filter.

BRIEF DESCRIPTION OF THE DRAWING

The aforementioned aspects and other features of the invention are explained in the following description, taken in connection with the accompanying drawing figures wherein.

Identically labeled elements appearing in different ones of the figures refer to the same element but may not be referenced in the description for all figures.

DETAILED DESCRIPTION OF THE INVENTION

Figure 1:
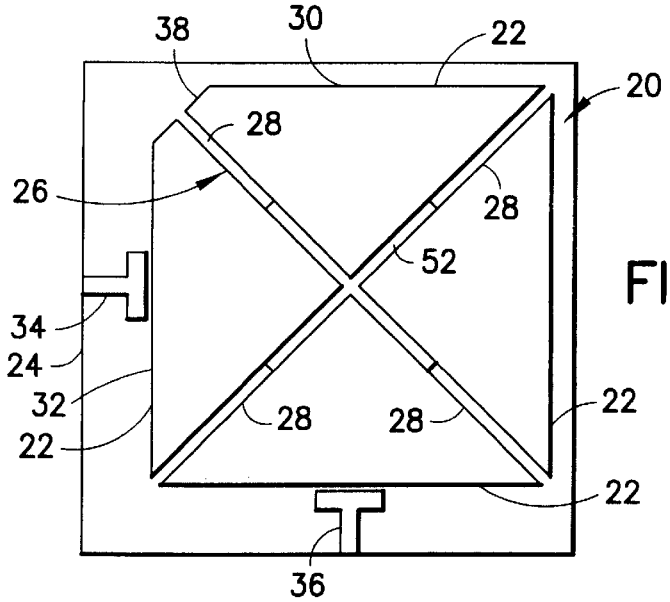
FIG. 1 shows a stylized plan view of a patch filter constructed in accordance with the invention.

FIG. 1 shows a voltage tunable patch filter element 20 comprising four triangular sections 22 of a metallic foil disposed on a dielectric, electrically insulating, low-loss substrate 24 such as sapphire. The metallic foil may be, by way of example, a gold foil or a metallic coating as may be provided by chemical vapor deposition on the substrate 24. The triangular sections 22 are separated by an assembly of slots, preferably a crossed slot assembly 26 consisting of four slot elements 28 which separate adjacent ones of the triangular sections 22. In a preferred embodiment of the invention, in each of the four slot elements 28, the edges of a slot element 28 are parallel. The four slot elements 28 extend as arms from a central region of the patch filter element 20. The patch filter element 20 may have the overall configuration of a square or rectangle wherein each side has a length substantially equal to one-half wavelength of an electromagnetic signal to which the patch filter element 20 resonates. The width of each of the slot elements 28 is much smaller than an edge 30 or 32 of the patch filter element 20 so as to allow the patch filter element 20 to resonate with an electromagnetic signal having a resonant wavelength equal to one-half the length of the edge 30 or the edge 32.

Two feeds 34 and 36, also constructed of metallic foil disposed on the substrate 24, serve to couple an electromagnetic signal into the patch filter element 20 and out of the patch filter element 20. By way of example, the feed 34 may serve as an input feed and the feed 36 may serve as an output feed. The feeds 34 and 36 have a slight spacing between their respective adjacent triangular sections 22 to enable capacitive coupling of electromagnetic signals between the feeds 34, 36 and the respective triangular sections 22. In order to couple between a first mode of vibration of electromagnetic wave parallel to the edge 30 and a second mode or vibration of electromagnetic wave, parallel to the edge 32 and perpendicular to the first mode of vibration, a discontinuity or region of asymmetry is provided as a shoulder 38 by cutting off a comer region of the patch of the patch filter element 20. For example, the cut for provision of the shoulder 38 may be inclined at an angle of 45 degrees relative to the edge 30, and may be located at a distance from the comer equal to approximately one tenth of the length of a side of the patch. Thereby, a mode of electromagnetic wave induced in the patch filter element 20 by a signal input at the feed 34 is converted by the shoulder 38 to an orthogonal mode of electromagnetic wave to be output at the feed 36. Thereby, two modes of vibration exist concurrently wherein one standing wave is directed parallel to the edge 30 and the other standing wave is directed parallel to the edge 32.

Figure 2:
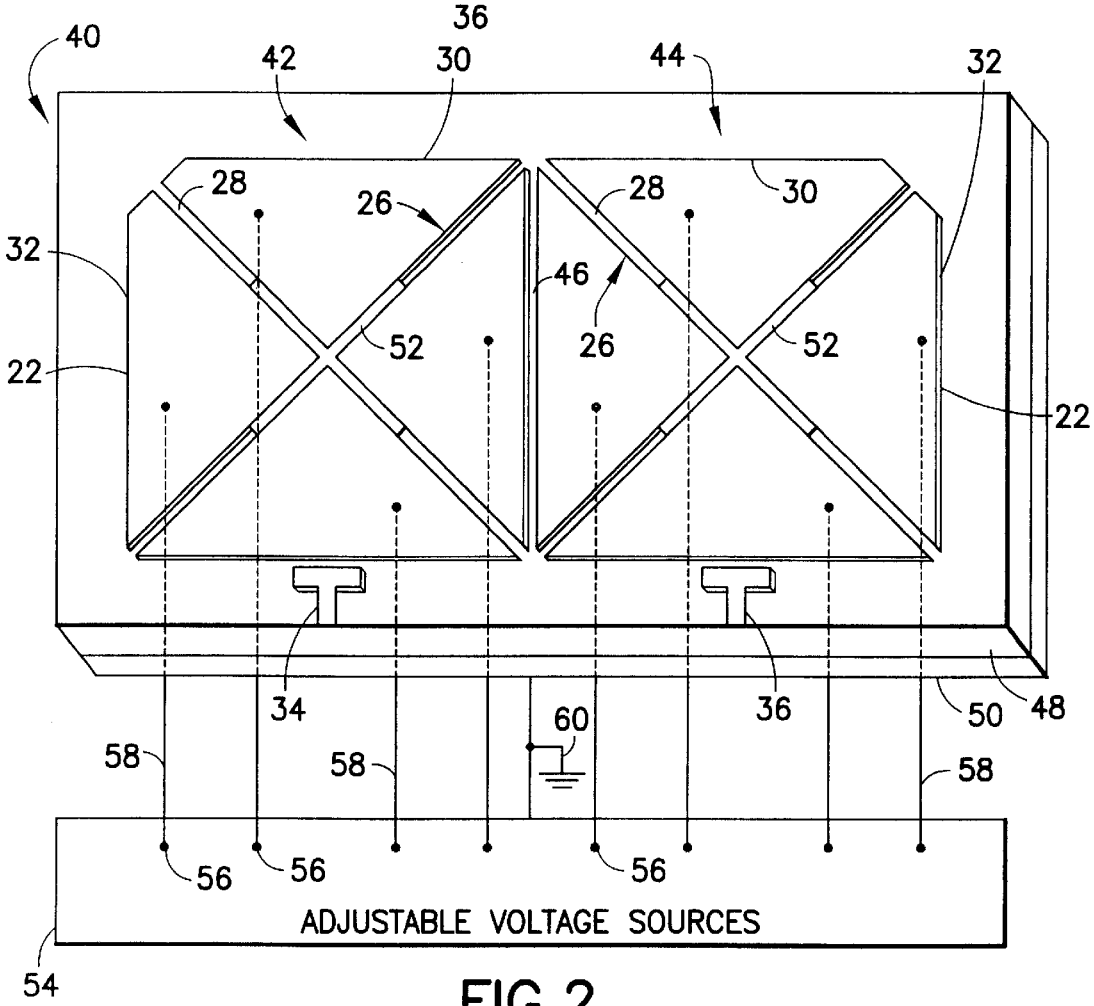
FIG. 2 shows a stylized perspective view of a four pole patch filter constructed in accordance with the invention.

FIG. 2 shows a filter 40 comprising a first patch filter element 42 and a second patch filter element 44 placed adjacent each other and separated by a slot 46 providing for coupling of electromagnetic signals between the first patch filter element 42 and the second patch filter element 44. Each of the patch filter element 42 and 44 is constructed in the same form as the patch filter element 20 of FIG. 1 and is supported upon a substrate 48 constructed in the same manner as the substrate 24 of FIG. 1. Each of the patch filter elements 42 and 44 include the shoulder 38 (described with reference to FIG. 1) wherein, in the left patch element 42, the shoulder is at the upper left corner, and in the right patch element 44, the shoulder 38 is in the upper left corner. A ground plane 50, in the form of a metallic foil, is located on the back side of the substrate 48 opposite the patch filter elements 42 and 44. A similar ground plane (not shown) is disposed on the back side of the substrate 24 of FIG. 1. It is recognized that the structure of the substrate 48 with the patch filter elements 42 and 44 on the front side thereof, and with the ground plane 50 located on the back side thereof constitutes a microstrip form of microwave circuit.

In accordance with a feature of the invention, at least a portion of each of the slot elements 28 of FIGS. 1 and 2 is filled with a ferroelectric oxide having a dielectric constant which is dependent on the magnitude of an electric field impressed across the slot. The ferroelectric oxide may be composed of lead-zirconium titanate $PbZr_xTi_{1-x}O_3$ or strontium titanate $SrTiO_3$. The ferroelectric oxide is shown in FIGS. 1 and 2 as a slab 52 of the ferroelectric oxide. The crossed slot assembly 26 provides for electrical insulation between the triangular sections 22 in each of the patch filter elements 20, 42 and 44 whereby different values of electric potential can be impressed upon respective ones of the triangular sections 22. This is accomplished, as shown in FIG. 2, by use of a set 54 of adjustable voltage sources 56 connected by conductors 58 to respective ones of the triangular sections 22 in the patch filter elements 42 and 44. The voltages provided by the sources 56 are applied to the triangular sections 22 relative to ground 60.

The presence of the dielectric properties of the slab 52 of the ferroelectric oxide alters the electrical length of a patch filter element 42, 44 in a direction parallel to the edge 30 and also in a direction parallel to the edge 32. As a result of the increased capacitance introduced by the slab 52, the patch filter element 42, 44 resonates at a lower frequency electromagnetic signal having a longer free-space wavelength because the shift in electrical length of the patch filter element 42, 44 allows the patch filter element 42, 44 to resonate with a lower frequency signal. An increase in the magnitude of the electric field impressed across the slab 52 in any one of the slot elements 28 provides for further adjustment of the capacitance and of the effective electrical length of the patch filter elements 42, 44 for resonance at still lower values of frequency. The electronic tuning of each of the patch filter element 42 and 44 of FIG. 2 applies also to the patch filter element 20 of FIG. 1 upon application of differing values of electric potential to respective ones of the triangular sections 22. Adjustment of the bias voltages across slots of the patch filter elements 20, 42 and 44 affects values of resonant frequency, as well as the amount of coupling of electromagnetic fields between adjacent ones of the triangular sections 22.

In FIG. 2, the feeds 34 and 36 have been positioned at the bottom edge of the filter 40 for coupling an electromagnetic signal into the first patch filter element 42 and for extracting the electromagnetic signal from the second patch filter element 44. The input signal is applied between the feed 34 and the ground plane 50, and the output signal is obtained between the feed 36 and the ground plane 50. By applying four separate values of electric potential to the four triangular sections 22 of the patch filter element 42 and also of the patch filter element 44, the filter 40 is operative as a four-pole bandpass filter, wherein the filter input is at the feed 34 and the filter output is at the feed 36. The application of the dc (direct current) bias voltages among respective ones of the triangular sections 22 provides for tunability in frequency as well as in bandwidth. The bandwidth is controlled mainly by a varying of the potential difference between the adjacent ones of the triangular sections 22, while keeping a relatively constant patch filter 3 frequency by appropriate setting of the dc bias voltages among the other triangular sections 22. A suitable range for utilization of the filter 40 is 12–20 GHz (gigahertz), with a tunable bandwidth of possibly 200–2000 MHz (megahertz). A typical width of the slot is in the range of approximately 20–30 mils in a patch measuring approximately one inch on a side for use in the 12–20 GHz range. With an unloaded Q have approximately 1000, an insertion loss of the filter 40 is approximately 2 dB (decibels). Biasing voltages are in the range of 5–50 volts. The width of a slot element 28 is in the range of approximately 20–50 mils, wherein a wider gap provides for reduced coupling between adjacent ones of the triangular sections 22.

It is noted that while, in FIG. 2, only two patch filter element 42 and 44 are shown, the filter 40 may be constructed with three or more of the patch filter elements (not shown) to provide a filter with a spectral passband characterized by six or more poles, wherein individual ones of the patch filter elements are spaced apart by slots which serve to couple electromagnetic signals between successive ones of the patch filter elements.

Figure 3:
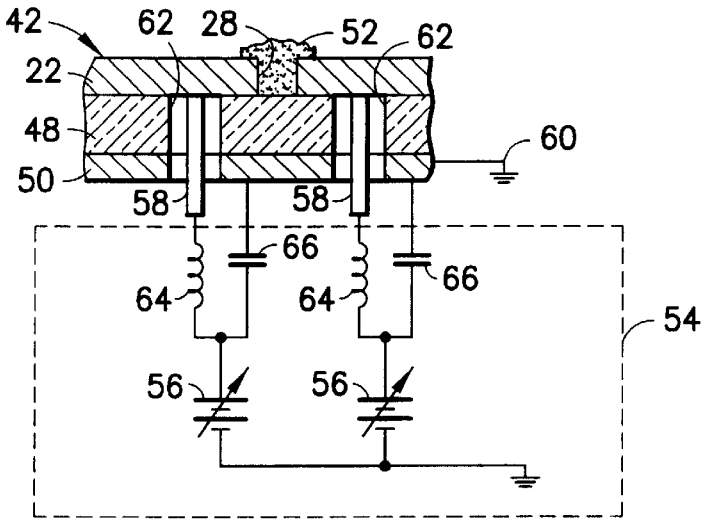
FIG. 3 shows a fragmentary sectional view of a microstrip construction of a patch filter with a feed through of biasing voltages.

FIG. 3 shows further detail in the connection of electric potential via the conductors 58 between the set 54 of voltage sources 56 and respective ones of the triangular sections 22 of a patch filter element, such as the patch filter element 42 of FIG. 2. In FIG. 3, for each of the conductors 58, a feed through passage 62 is constructed within the substrate 48 and the ground plane 50 to allow passage of the conductor 58 via the passage 62 through both the ground plane 50 and the substrate 48 to make electrical contact with a back side of a corresponding one of the triangular sections 22. Connection between the conductor 58 and a corresponding one of the voltage sources 56 is made by an inductor 64. Each inductor 64 serves to block passage of electric signals at microwave frequencies between the corresponding triangular section 22 and the corresponding voltage source 56, the latter being represented by the symbol of a variable battery in FIG. 3. Also, for each of the conductors 58, a capacitor 66 connects between the ground plane 50 and a junction between the inductor 64 and the voltage source 56. The capacitor 66 serves to shunt any leakage microwave energy from the voltage source 56 to the ground plane 50. Also shown in FIG. 3 is the filling of the portion of a slot element 28 with the slab 52 of the ferroelectric oxide.

Figure 4:
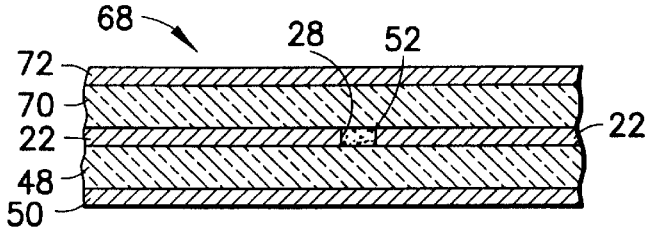
FIG. 4 is a fragmentary sectional view of a stripline construction of a patch filter.

FIG. 4 demonstrates a stripline form of construction 68 of the filter circuitry of FIGS. 1 and 2. FIG. 4 shows two triangular sections 22 separated by a slot element 28 filled with the slab 52, the triangular sections 22 being disposed on a front side of the slab 48 with the ground plane 50 on the back side thereof, as has been disclosed previously with reference to FIG. 2. In addition, the construction 68 of FIG. 4 includes a further layer of substrate 70 on the front side of the triangular sections 22 with a further ground plane 72 disposed on the front side of the substrate 70 to complete the stripline construction 68.

Figure 5:
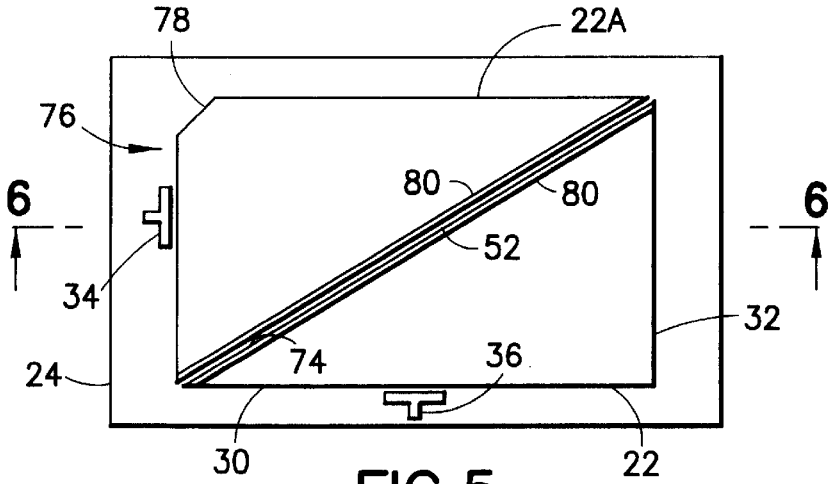
FIG. 5 shows a stylized plan view of an alternative embodiment of a patch filter having a single slot of uniform cross section and a comer cut to generate orthogonal modes from a single mode excitation of the filter, and wherein the sides of the slot are built up to provide for increased capacitance.
Figure 6:
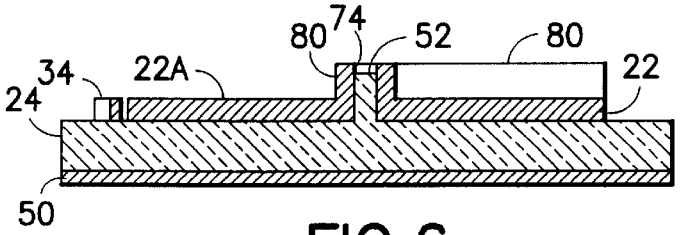
FIG. 6 is a sectional view of the embodiment of FIG. 5 taken along the line 6—6 in FIG. 5.

FIGS. 5 and 6 show a modification of the construction of FIG. 1 wherein only one slot 74 having continuous straight edges is employed for separating two sections 22 and 22A of a patch filter element 76 that operates in a fashion similar to the patch filter element 20 of FIG. 1. The two sections 22 and 22A are supported upon a substrate such as the substrate 24. The two sections 22 and 22A differ in that the section 22 is a triangular section while the section 22A is a triangular section wherein a portion of the right angle corner has been deleted at 78. The corner cut at 78 induces orthogonal modes of vibration of an electromagnetic signal introduced by the feed 34, wherein one mode is parallel to an edge 30 and the other mode is parallel to an edge 32 of the triangular section 22, which modes of vibration have been disclosed above with reference to FIGS. 1 and 2.

In accordance with a further feature of the invention, edge portions of the sections 22, 22A are raised to form walls 80 which face each other along opposite sides of the slot 74. A slab 52 of the ferroelectric oxide is located in the slot 74 between the walls 80, and rises to a height above the substrate 24 greater than the thickness of the foil 22, 22A. The presence of the walls 80 increases the capacitance across the slot 74, as compared to the capacitance obtainable by the sections 22 of FIGS. 1 and 2 without the walls, because of the increased area of the capacitor plates represented by the walls 80. In addition, there is more space available for holding the ferroelectric material in that the slab 52 can be made much thicker than in the structure of FIGS. 1 and 2. Therefore, the embodiment of FIGS. 5 and 6 presents the feature of enlargement of capacitance by choice in the height of the walls 80, as well as in the choice of the amount of ferroelectric material which can be placed in the slot. The construction of the walls 80 can be employed also in the circuit of FIG. 2, whereby the electrical adjustment in the value of capacitance occurs over a range of larger values of capacitance.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A filter element, comprising:

an electrically-insulating substrate;

an electrically conductive region on a first surface of said substrate;

a slot dividing said region into a plurality of sections, said sections being insulated from each other;

mode means for inducing orthogonal modes of vibration of an electromagnetic field about said plurality of sections; and voltage tunable means providing a differences in voltage among said sections, and including ferroelectric material disposed in said slot for adjusting a resonant frequency of said electrically conductive region.

2. A filter element, comprising:

an electrically-insulating substrate;

an electrically conductive region on a first surface of said substrate;

a slot dividing said region into a plurality of sections;

mode means for inducing orthogonal modes of vibration of an electromagnetic field about said plurality of sections; and voltage tunable means at said slot for adjusting a resonant frequency of said electrically conductive region; and wherein said voltage tunable means comprises a slab of ferroelectric material disposed in said slot, and wherein sections of said plurality of sections are electrically insulated from each other to permit establishment of a bias voltage between adjacent ones of said sections.

3. A filter element according to claim 2 further comprising a ground plane on a second surface of said substrate opposite said conductive region to provide for a microstrip form of said filter element.

4. A filter element according to claim 3, wherein said conductive region has a square shape, and said slot is a crossed slot having four slot elements extending outward from a central region of said conductive region to provide an array of four triangular sections in said plurality of sections, and wherein said mode means is a discontinuity along an edge of said conductive region.

5. A filter element according to claim 3, wherein said conductive region has a square shape, and wherein said mode means is a corner cut-out section of said conductive region.

6. A filter element according to claim 3, wherein said substrate is a first substrate and said ground plane is a first ground plane, the filter comment further comprising a second substrate and a second ground plane disposed on a side of said conductive region opposite said first substrate and said first ground plane to provide for a stripline form of said filter element.

7. A filter element according to claim 3, wherein said conductive region has a square shape and each of said sections has a triangular shape, the filter element further comprising a first feed coupled to a first of said sections and a second feed coupled to a second of said sections to serve as input and output ports of the filter element.

8. A filter element according to claim 2 further comprising electrically conductive walls extending along opposite sides of said slot in directions transverse to a surface of said conductive region, said slab being disposed between said walls, wherein said walls and said slab increase capacitance across said slot between adjacent ones of said sections.

9. An electrically tunable multiple-pole patch filter, comprising:

a plurality of filter elements, each of said filter elements comprising an electrically-insulating substrate wherein the substrate of one of said filter elements adjoins the substrate of a second of said filter elements to provide for a common substrate, an electrically conductive region on a first surface of said substrate, a slot dividing said region into a plurality of sections, mode means for inducing orthogonal modes of vibration of an electromagnetic field about said plurality of sections, and voltage tunable means at said slot for adjusting a resonant frequency of said electrically conductive region, wherein said voltage tunable means comprises a slab of ferroelectric material disposed in said slot, and wherein sections of said plurality of sections are electrically insulated from each other to permit establishment of a bias voltage between adjacent ones of said sections;

a coupling slot located between the conductive regions of one of said filter elements and an adjacent one of said filter elements; and means for establishing bias voltages between sections of said conductive region in each of said filter elements, a choice of voltage among said bias voltages serving to tune the patch filter.

10. A filter according to claim 9 further comprising an input feed coupled to a section of the conductive region in a first of said filter elements and an output feed coupled to a section of the conductive region in another of said filter elements.

11. A filter according to claim 10 further comprising a ground plane extending along a surface of said common substrate opposite the conductive region of respective ones of said filter elements to provide for a microstrip construction to said patch filter.

* * * * *